US006176106B1

(12) United States Patent
Lonati et al.

(10) Patent No.: US 6,176,106 B1
(45) Date of Patent: Jan. 23, 2001

(54) DIAL OR HALF-DIAL FOR SINGLE-CYLINDER CIRCULAR HOSIERY KNITTING MACHINES, PARTICULARLY FOR PRODUCING TUBULAR ITEMS CLOSED AT ONE LONGITUDINAL END

(75) Inventors: Francesco Lonati; Ettore Lonati; Tiberio Lonati; Fausto Lonati, all of Brescia (IT)

(73) Assignee: Lonati S.p.A., Monza (IT)

( * ) Notice: Under 35 U.S.C. 154(b), the term of this patent shall be extended for 0 days.

(21) Appl. No.: 09/419,624

(22) Filed: Oct. 18, 1999

(30) Foreign Application Priority Data

Oct. 28, 1998 (IT) ..... MI98A2312

(51) Int. Cl.[7] ..... D04B 15/02
(52) U.S. Cl. ..... 66/95; 66/147
(58) Field of Search ..... 66/15, 19, 28, 66/31, 32, 33, 92, 93, 95, 107, 148, 142, 14

(56) References Cited

U.S. PATENT DOCUMENTS 2,730,879 * 1/1956 Jette ..... 66/95
2,730,880 * 1/1956 Larkin ..... 66/95
2,873,594 * 2/1959 Larkin ..... 66/95
3,609,998 * 10/1971 Mutze et al. ..... 66/95
3,800,563 * 4/1974 Billi ..... 66/95
4,005,589 * 2/1977 Uhlir ..... 66/95
4,646,542 * 3/1987 Tenconi ..... 66/95
5,855,122 * 1/1999 Lonati et al. ..... 66/95

* cited by examiner

*Primary Examiner*—Danny Worrell
(74) *Attorney, Agent, or Firm*—Guido Modiano; Albert Josif; Daniel O'Byrne

(57) ABSTRACT

A dial or half-dial for single-cylinder circular hosiery knitting machines, particularly for producing tubular items closed at one longitudinal end, which comprises a dial or half-dial body which is substantially shaped like a disk or half-disk and is provided, on at least one of its two faces, with a plurality of radial slots, each of which slideably accommodates at least one hook. The hooks have a longitudinal slit which is open in the direction of the axis of the dial or half-dial body. The slit gives a portion of the body of the hooks a bifurcated shape which engages the two opposite faces of the dial or half-dial body.

23 Claims, 6 Drawing Sheets

DIAL OR HALF-DIAL FOR SINGLE-CYLINDER CIRCULAR HOSIERY KNITTING MACHINES, PARTICULARLY FOR PRODUCING TUBULAR ITEMS CLOSED AT ONE LONGITUDINAL END

BACKGROUND OF THE INVENTION

The present invention relates to a dial or half-dial for single-cylinder circular hosiery knitting machines, particularly for producing tubular items closed at one longitudinal end.

It is known that some types of single-cylinder circular hosiery knitting machines, in order to perform particular types of knitting, are equipped with a dial which is arranged above the needle cylinder and coaxially thereto. The dial of these machines generally has a substantially disk-like body, on the upper face whereof there is a plurality of radial slots, each accommodating a hook which can be actuated along the corresponding radial slot in order to cooperate, thanks to its hooked end that protrudes from the dial body, with the needles in manufacturing the items.

A cover for closing the radial slots in an upward region and therefore retain the hooks inside the corresponding radial slots, is generally arranged above the dial body. Furthermore, the hook actuation cams are associated with the cover of the dial. Said cams form paths which can be engaged by the heels of the hooks, which protrude upwards from the radial slots, so as to produce the movement of the hooks, inside the corresponding radial slots of the dial body, towards or away from the axis of the dial in order to perform the various kinds of knitting.

The cover as an element for closing the radial slots in an upward region, in addition to significantly increasing the mass of the dial as a whole and considerably affecting production and assembly costs, causes problems during maintenance of the dial or hooks.

In these situations it is in fact often necessary to fully remove the dial from the machine and disassemble the cover in order to be able to access the hooks located in the radial slots of the dial body.

These problems are even greater in the case of single-cylinder circular hosiery knitting machines which can close a longitudinal end of the tubular knitted item during its production.

These machines are in fact generally provided with a half-dial which is located above the needle cylinder of the machine so as to overlap one half of the needle cylinder and can be turned over, substantially through an angle of 180°, about a diametrical axis of the needle cylinder in order to face one half of the needle cylinder or the other half of the needle cylinder. Inside the overturning half-dial there is a plurality of radial slots or twin radial slots, in each of which two or more hooks with mutually opposite hooked ends are arranged. The hooks of each slot or twin slot can be actuated individually in order to engage the loops formed by the needles of one half of the needle cylinder and to retain them inside the hooked ends during the overturning of the half-dial about the diametrical axis. After overturning, the hooks are actuated again so as to release the previously retained loops, which are engaged by the needles of the other half of the needle cylinder.

After transferring the loops formed by one half of the needle cylinder to the needles of the other half of the needle cylinder, one longitudinal end of the tubular item produced by the circular hosiery knitting machine is closed.

The hooks used in these machines are generally provided with a heel which protrudes upwards from the half-dial body and with a heel which protrudes downwards from the half-dial. Because of this, on the bottom of the radial slots there is an adapted slit for the passage of the heel which must protrude downwards from the half-dial.

Above the half-dial there are also cams which determine paths for said heels, so as to produce the coordinated movement of the hooks in a radial direction with respect to the axis of the needle cylinder in order to engage or release the loops of knitting.

When the half-dial is turned over about the diametrical axis, the hooks engage said cams by means of the heel which, in the non-overturned position, protruded downwards from the dial.

In these kinds of machine the cover on the half-dial, which is required in order to retain the hooks inside the corresponding radial slots of the half-dial, causes additional problems, since it significantly increases the mass of an element which must be overturned and increases the complexity of the production and assembly of the half-dial, and interventions on the hooks in case of maintenance are even more difficult indeed because it is necessary to disassemble the cover arranged on the half-dial.

SUMMARY OF THE INVENTION

The aim of the present invention is to solve the above problems by providing a dial or half-dial for single-cylinder circular hosiery knitting machines, particularly for machines producing tubular items closed at one longitudinal end, whose structure is considerably simpler than conventional dials or half-dials, so as to be easy to manufacture and assemble.

Within the scope of this aim, an object of the invention is to provide a dial or half-dial which makes hook maintenance particularly simple and easy.

Another object of the invention is to provide a dial or half-dial which can ensure high precision both in loading the loops of knitting and in releasing them during the operation of the machine.

Another object of the invention is to provide a dial or half-dial in which the cams for actuating the hooks are structurally simple.

Another object of the invention is to provide a dial for single-cylinder circular machines which can be used to transfer the loops of knitting from one half of the needle cylinder to the other half of the needle cylinder or to perform knitting which requires the simultaneous use of the needles of the needle cylinder and of the hooks of the dial, such as for example the formation of double-thickness regions such as the top of socks.

This aim, these objects and others which will become apparent hereinafter are achieved by a dial or half-dial for single-cylinder circular hosiery knitting machines, particularly for producing tubular items closed at one longitudinal end, comprising a dial or half-dial body which is substantially shaped like a disk or half-disk and is provided, on at least one of two opposite faces thereof, with a plurality of radial slots, each of which slideably accommodates at least one hook, characterized in that the hooks have a longitudinal slit which is open in the direction of an axis of said dial or half-dial body, said slit giving a portion of the body of said hooks a bifurcated shape which engages the two opposite faces of said dial or half-dial body.

BRIEF DESCRIPTION OF THE DRAWINGS

Further characteristics and advantages of the invention will become apparent from the description of a preferred but not exclusive embodiment of the dial or half-dial according to the invention, illustrated only by way of non-limitative example in the accompanying drawings, wherein.

DESCRIPTION OF THE PREFERRED EMBODIMENTS

Figure 1:
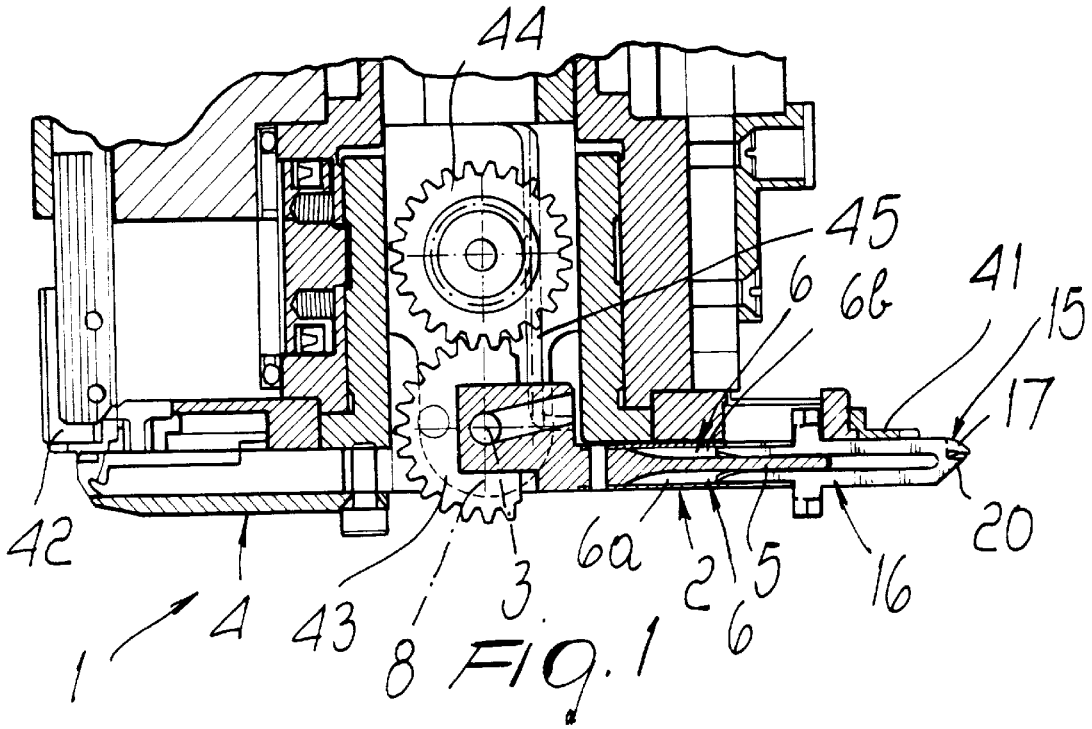
FIG. 1 is a schematic sectional view of a dial according to the invention, taken along a radial plane.
Figure 2:
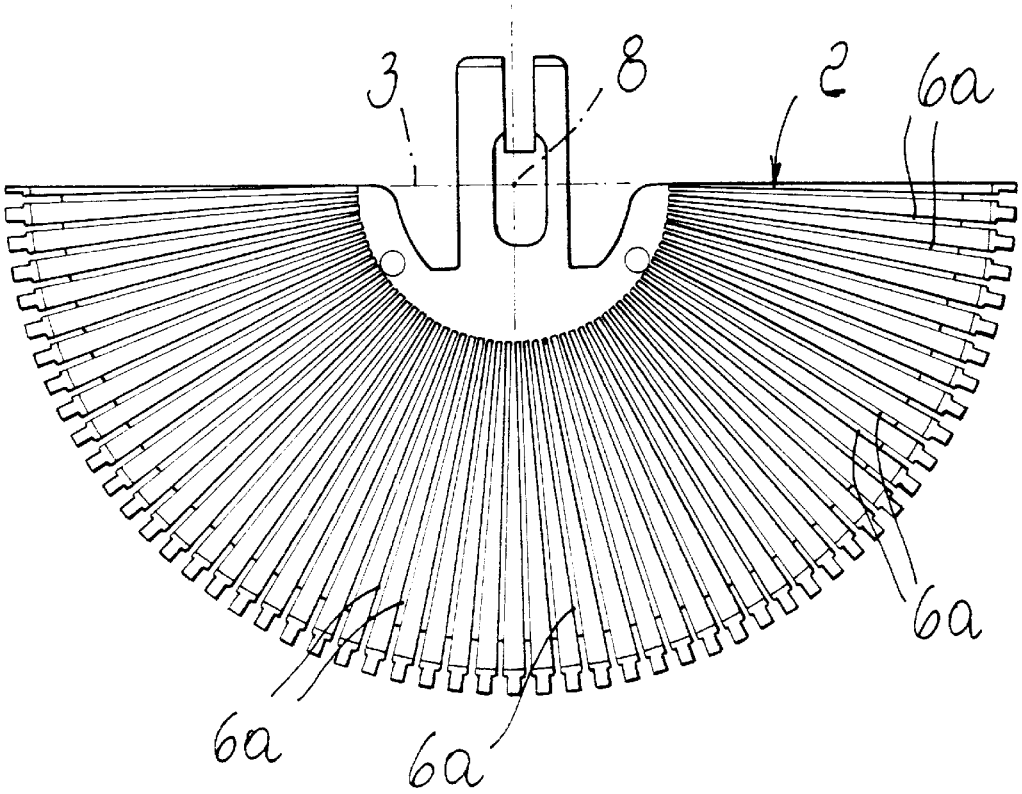
FIG. 2 is a top plan view of the body of a half-dial according to the invention.

For the sake of simplicity in description, the invention is now described with reference to the accompanying Figures, which relate to a dial 1 provided with a portion or half-dial 2 which can be overturned about a diametrical axis 3 with respect to the remaining non-overturning portion 4; however, the concept of the invention can also be applied to dials which do not have overturning portions and to half-dials even without the portion 4. The dial 1, shown in the Figures, is a dial meant to be fitted to a single-cylinder circular hosiery knitting machine capable of producing tubular items which are closed at one of their axial ends and double-thickness knitting or tubular edges, such as for example the top of socks.

With reference to the above Figures, the portion or half-dial 2, hereinafter referenced simply as half-dial, comprises a half-dial body 5 which is substantially shaped like a half-disk which has, on at least one of its two faces, a plurality of radial slots 6, each of which slideably accommodates at least one hook. According to the invention, the hooks have a longitudinal slit 7 which is open in the direction of the axis 8 of an imaginary disk-like body of which the body 5 constitutes substantially one half, i.e., the axis 8 of the dial 1 for the illustrated embodiment, and said slit 7 gives a portion of the body of the hooks a bifurcated shape which engages the two opposite faces of the body 5 of the half-dial.

Preferably, the body 5 of the half-dial has radial slots 6*a* in its upper face and radial slots 6*b* in its lower face. The longitudinal slit 7 formed in the body of the hooks is delimited by two mutually opposite sides 9*a* and 9*b* which are substantially mutually parallel and slideably engage respectively the bottom of the corresponding radial slot 6*a* formed in the upper face of the body 5 of the half-dial and the bottom of the corresponding radial slot 6*b* formed in the lower face of the half-dial body 5.

In the illustrated embodiment there are, for each radial slot 6 or slots 6*a*, 6*b* of the half-dial 2, respectively a first hook 15 and a second hook 16 which are arranged mutually side by side inside a same radial slot 6 or slots 6*a*, 6*b*.

More particularly, the first hook 15 has a laminar body which is arranged on a radial plane of the body 5 of the half-dial 2. One longitudinal end 17 of the first hook 15 is hook shaped, with a point which is directed upwards when the hook 15 is coupled to the body 5 of the half-dial 2 in the non-overturned position. At the opposite longitudinal end there is the inlet of the longitudinal slit 7 which, as mentioned, is meant to be engaged by the body 5 of the half-dial 2.

An upper heel 18 protrudes from the upper side of the body of the first hook 15, in an intermediate region of the longitudinal extension of the hook 15, and a second heel 19 protrudes from the lower side of the first hook 15. The heels 18 and 19 are substantially mutually aligned and protrude at right angles to the longitudinal extension of the hook 15, i.e., parallel to the axis 8.

The heels 18 and 19 also have a step-like shape on their side directed toward the hooked end 17.

The second hook 16 also has a laminar body which is meant to be is arranged on a radial plane inside the corresponding radial slot 6 or slots 6*a*, 6*b* of the body 5 of the half-dial 2.

The second hook 16 also has a hooked longitudinal end 20 which has a point which is directed downwards when the hook 16 is coupled to the body 5 of the half-dial 2 in the non-overturned position. In practice, the second hook 16 is arranged inside the corresponding radial slot 6 or slots 6*a*, 6*b* of the dial that lies laterally adjacent to the first hook 15, so that its hooked end 20 lies opposite the hooked end 17 of the first hook, as will become apparent hereinafter.

The body of the second hook 16, starting from the longitudinal end that lies opposite the hooked end 20, also is provided with the slit 7, which can be engaged by the body 5 of the half-dial 2.

A heel 21 protrudes from the upper side of the second hook 16 in an intermediate region of the longitudinal extension of the hook 16, and a lower heel 22 protrudes from the lower side of the second hook 16.

In the second hook 16 also, the heels 21 and 22 are substantially mutually aligned and lie substantially at right angles to the longitudinal extension of the hook 16, i.e., parallel to the axis 8.

In this case there is a step-like region on the side of the heels 21 and 22 that is directed away from the hooked end 20 of the hook 16.

The heels 21 and 22 of the second hook 16 are arranged along the longitudinal extension of the body of the second hook 16, with respect to the arrangement of the heels 18 and 19 of the first hook 15, so that when the first hook and the second hook are placed inside a same radial slot 6 or slots 6*a*, 6*b* of the half-dial 2 they laterally overlap at least partially.

In the second hook 16, at least the portion 23 that is arranged proximate to the hooked end 20 can flex elastically toward or away from the first hook 15 arranged inside the same radial slot 6 or slots 6*a*, 6*b* of the half-dial 2.

When no forces are acting on it, the flexible portion 23 has a concave shape on the side of the second hook 16 that is meant to face the first hook 15.

Moreover, in order to facilitate the elastic flexibility of the portion 23, such portion 23 is conveniently thinner than the remaining part of the body of the second hook 16.

The first hook 15 has, on the side of the hooked end 17 that is meant to face the second hook 16, a recess 24 for receiving the hooked end 20 of the second hook 16 when it flexes toward the first hook 15.

The heels of the hooks 15 and 16 can be engaged by actuation means which are constituted by cams facing the half-dial in an upward region.

The cams form, for the heels of the first hook 15 and of the second hook 16, paths which move the hooks 15 and 16 in a radial direction with respect to the body 5 of the half-dial 2.

Figure 3:
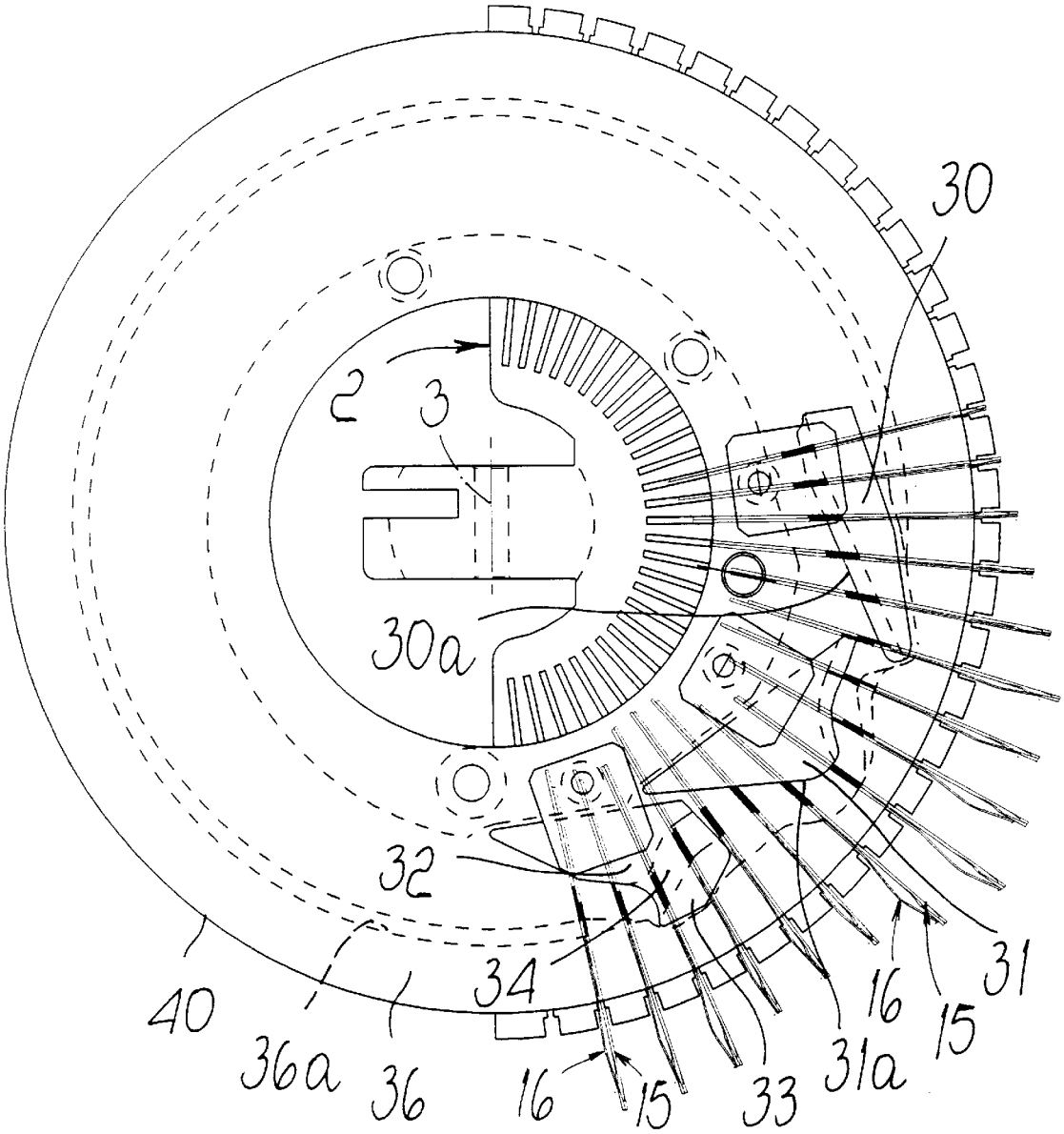
FIG. 3 is a schematic top plan view of the cams for actuating the hooks of the dial according to the invention, showing only part of the hooks.

More particularly, as shown in particular in FIG. 3, there is a retraction cam 30 which has a profile 30*a* which is inclined with respect to a radial plane that passes through the axis 8 and can engage the heels of the hooks 15 and 16 so as to move them toward the axis 8 along the corresponding radial slot 6 or slots 6*a*, 6*b*.

The actuation cams comprise an extraction cam 31 which has a profile 31*a* which is inclined, with respect to a radial plane that passes through the axis 8, in the opposite direction with respect to the inclination of the profile 30*a* of the cam 30, and can engage the heels of the hooks 15 and 16 in order to cause their movement, inside the corresponding slot 6 or slots 6*a*, 6*b*, in the opposite direction with respect to the axis 8.

The actuation means further comprise two mutually facing cams 32 and 33 which form, between them, a passage 34 which can be engaged by the heels of the hooks 15 and 16 in order to produce a limited movement of the hooks 15 and 16 toward the axis 8.

The actuation means also comprise an annular cam 36 which runs around the axis 8 and delimits the movement of the hooks 15 and 16 in the opposite direction with respect to the axis 16. The annular cam 36 has, in the region of the extraction cam 31, a recess to allow the movement, imparted by the extraction cam 31, of the hooks 15 and 16 in the opposite direction with respect to the axis 8.

It should be noted that the cams 30, 31, 32 and 33 can move on command parallel to the axis of the needle cylinder, which coincides with the axis 8, for example by means of pneumatic, mechanical or electromechanical actuators, so that they can be moved from an active position, in which they interfere with the heels of the hooks 15 and 16, to an inactive position, in which they do not interfere with the heels of the hooks, while the cam 36 is fixed and is therefore always in a position which is adapted to interfere with the heels of the hooks 15 and 16.

The upper heels of the hooks 15 and 16 and the lower heels of the hooks 15 and 16 can selectively engage the cams that constitute the actuation means, depending on whether the half-dial 2 is overturned, as shown in FIG. 1, or not about the diametrical axis 3.

In at least some of the hook actuation cams, the profile that is to be engaged by the heels of the hooks 15 and 16 is step-shaped so as to simultaneously or separately actuate the hooks along the corresponding radial slot 6 or slots 6*a*, 6*b* of the half-dial 2.

The hook actuation cams are mounted on a support 40 which is supported by the load-bearing structure of the machine independently of the half-dial 2.

The non-overturning portion 4 also has a substantially semicircular body and is rigidly associated or associable with the needle cylinder in rotating about the axis 8. The portion 4, according to the requirements, can be provided with radial slots only on its upper face and be equipped with conventional hooks, as shown in FIG. 1, provided with heels which protrude upwards from the portion 4 and are adapted to be actuated by the cams 30, 31, 32, 33 and 36, or can be provided substantially like the half-dial 2 and be equipped with hooks similar to the hooks 15, i.e., with a hooked longitudinal end in which the point is directed upwards. In this case, the hooks fitted to the non-overturning portion 4 may be provided without the lower heels.

Conveniently, means are provided which are adapted to contrast or at least limit the elastic flexing of the hooks 15 and 16 in their plane of arrangement, i.e., in planes arranged radially with respect to the body 5 of the dial or half-dial 2, particularly when said hooks 15 and 16 are in the maximum extraction position with respect to the body 5 of the dial or half-dial 2 and are subjected to the action of the stitch engaged by said hooks 15 and 16.

Said means adapted to contrast or limit the elastic flexing of the hooks 15 and 16 comprise at least one cover 50 which is fixed to at least one face of the body 5 of the dial or half-dial 2 and closes the side of the radial slots 6*a* and 6*b* that lies opposite the bottom of said slots 6*a* and 6*b* at least in the region occupied by the portion of the hooks 15 and 16 that protrudes from the heels 18, 19, 21, 22 toward the axis 8. In the illustrated embodiment there is a cover 50 on each one of the two faces of the body 5 of the dial or half-dial 2.

For the sake of completeness in description, it is noted that an annular blade 41 is fixed to the portion 4, is coaxial to the dial 1 and cooperates with a cutter 42 arranged above the dial 1 for cutting the threads.

The half-dial 2 can be overturned, as described in U.S. Pat. No. 5,816,075, by means of a pinion 43 which is fixed to the half-dial, has an axis which coincides with the axis 3 and meshes, either directly or with an additional pinion 44 interposed, with a rack 45 which is parallel to the axis 8 and can be actuated on command parallel to said axis 8.

The operation of the dial or half-dial according to the invention is as follows.

Figure 6:
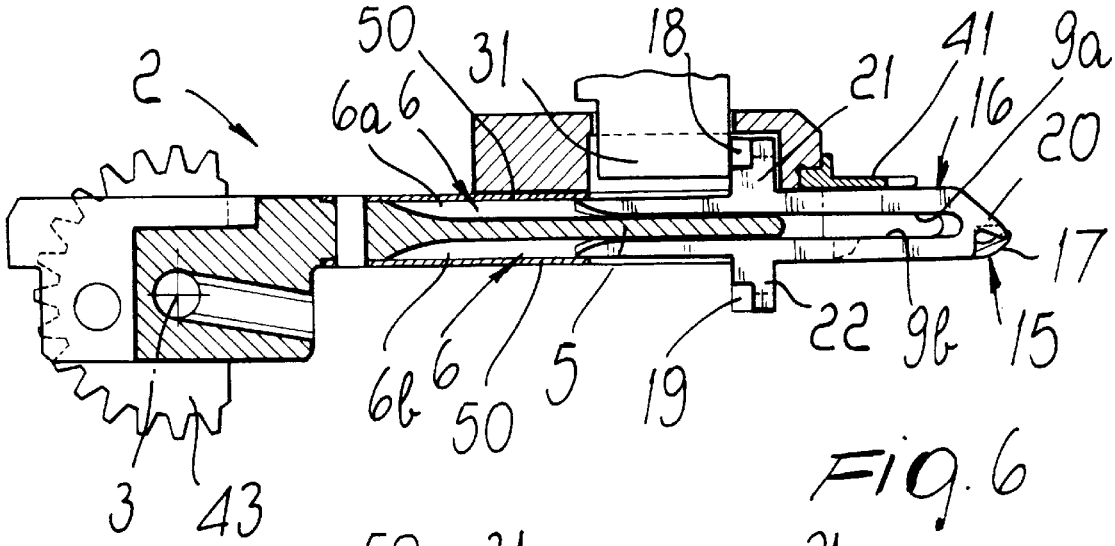

In producing a tubular item which is closed at one of its longitudinal ends, for example according to the method disclosed in U.S. Pat. No. 5,727,400, the hooks 15 and 16 are subjected to the action of the cam 31 in the working position, which causes their movement in the opposite direction with respect to the axis 8, making them protrude, with their hooked end, from the half-dial 2. The cam 31 simultaneously makes contact with the side of the upper heel 18 that is directed toward the axis 8 and the lower part of the step of the upper heel 21, causing the upper heels of the two hooks 15 and 16 to laterally overlap perfectly. In this condition, the hooked end 20 of the second hook 16 is arranged laterally adjacent to the hooked end 17 of the first hook 15. The portion 23 of the second hook 16, being extracted from the corresponding radial slot 6 or slots 6*a*, 6*b* of the dial 2, is laterally spaced from the first hook 15 (FIG. 6).

Figure 7:
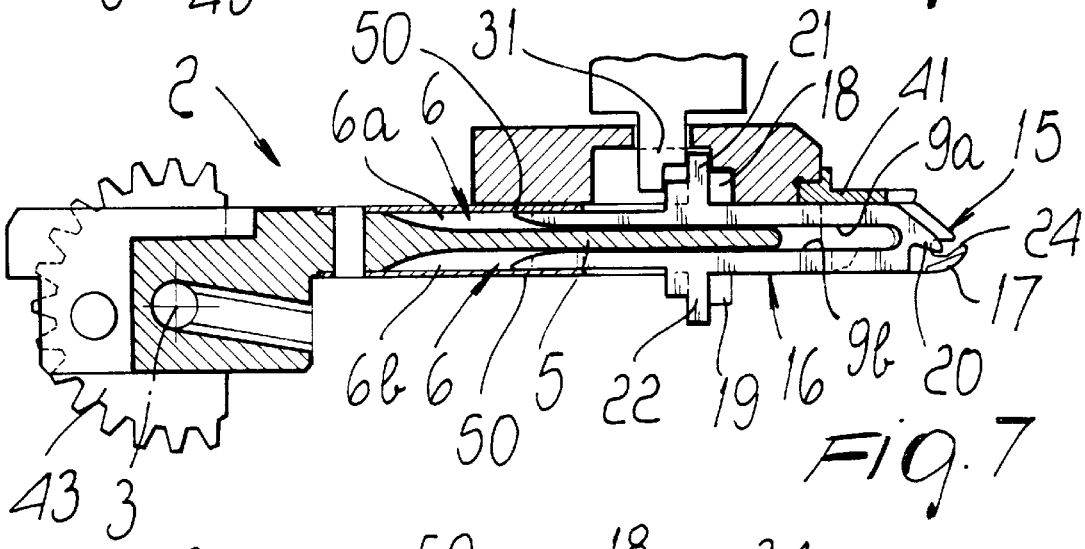

The heels 18 and 21 then engage, with their side directed toward the hooked end 17 and 20, a step-shaped portion of the profile 36*a* of the cam 36 while they transit at a portion of the profile 31*a* of the cam 31 which is also step-shaped. As a consequence of this fact, the hooks 15 and 16 are moved in the direction of the axis 8 but the second hook 16 moves more than the first hook 15. Because of this, the hooked end 20 of the second hook 16 is moved backward with respect to the hooked end 17 of the first hook 15 (FIG. 7). In this position, the hooked end 17 of the first hook 15 can receive the thread between the loops formed by the needles of one half of the needle cylinder, i.e., the half of the needle cylinder that lies below the overturning half-dial 2.

Figure 8:
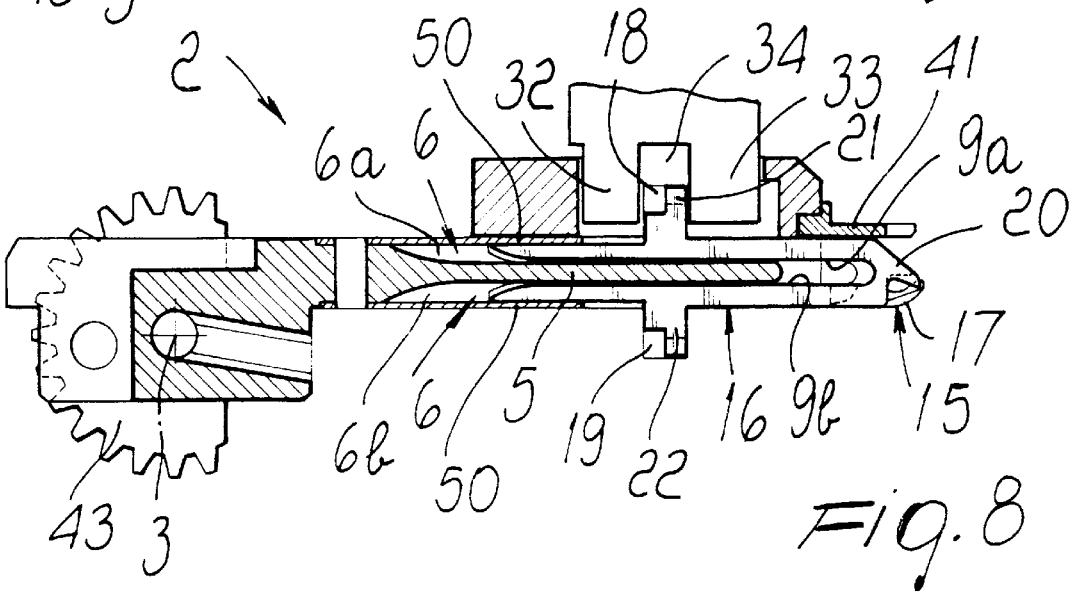

After the descent of the needles in order to form the loops of knitting, the upper heels of the hooks 15 and 16 transit through the passage 34 between the cams 32 and 33, being moved into the working position (FIG. 8). Owing to the fact that the cam 33 engages the side of the heels that is directed away from the axis 8 at the lower part of the step of the heel 18 and the cam 32 engages the opposite side of the heels in the lower region of the step of the heel 21, the two hooks 15 and 16 are moved so as to partially retract into the corresponding slot 6 or slots 6*a*, 6*b*, but the hook 16 is retracted slightly less than the hook 15. The portion 23 of the second hook 16 engages the side of the corresponding slot 6 or slots 6*a*, 6*b*, and starts to flex toward the first hook 15, resting with its hooked end 20 in the recess 24.

Figure 9:
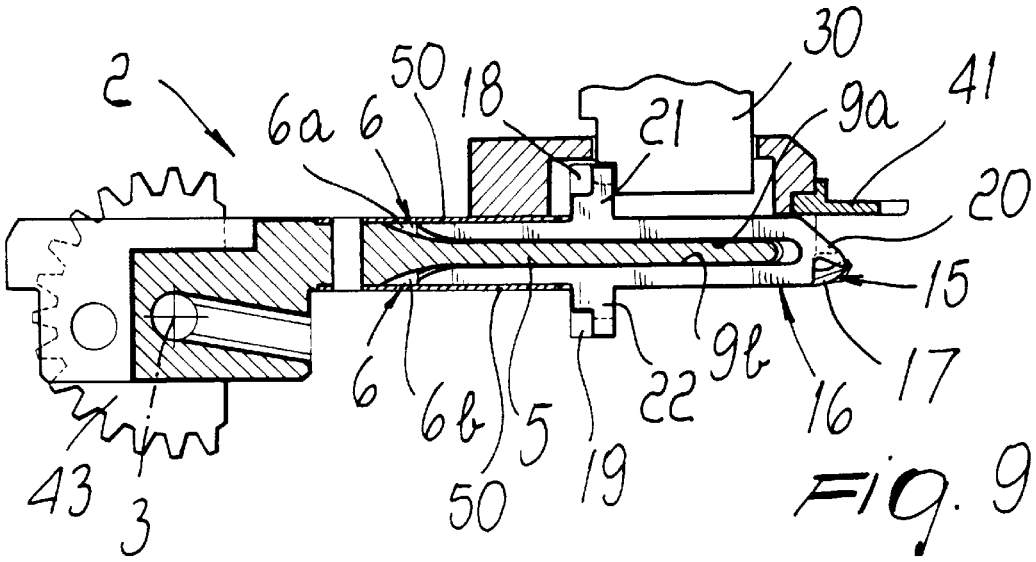

The heels of the hooks 15 and 16 then engage the profile 30*a* of the cam 30, which is moved into the working position, causing a further retraction of the hooks 15 and 16 into the slots 6. As a consequence of this fact, the portion 23 of the hook 16, by sliding along the side of the corresponding slot 6 or slots 6*a*, 6*b*, flexes further toward the hook 15 with its point in the recess 24 (FIG. 9). In these conditions, the loops of knitting are firmly retained between the hooked ends 17 and 20 of the hooks 15 and 16.

The half-dial 2 is then overturned about the diametrical axis 3 and, by means of a partial rotation of said half-dial 2 with respect to the portion 4 about the axis 8, as described in U.S. Pat. No. 5,816,075, it is arranged laterally adjacent and overturned with respect to the portion 4, as shown in FIG. 1.

Figure 10:
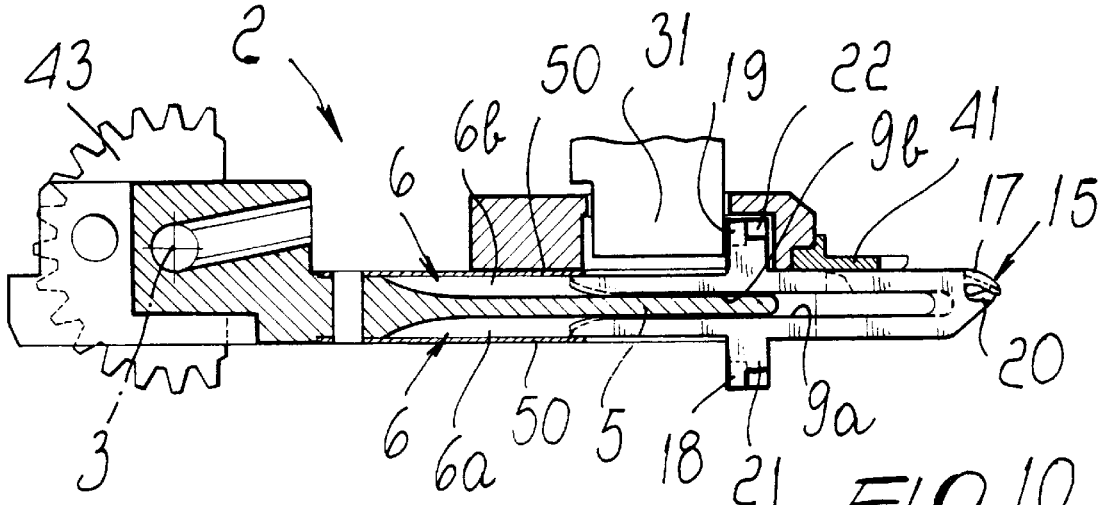

At this point, the lower heels 19 and 22 of the hooks 15 and 16 engage the cam 31 in the working position and said cam again moves the hooks away from the axis 8 (FIG. 10), thus also spacing the portion 23 of the second hook 16 from the side of the first hook 15, so that a needle of the cylinder can enter the space between the hooks 15 and 16.

Figure 11:
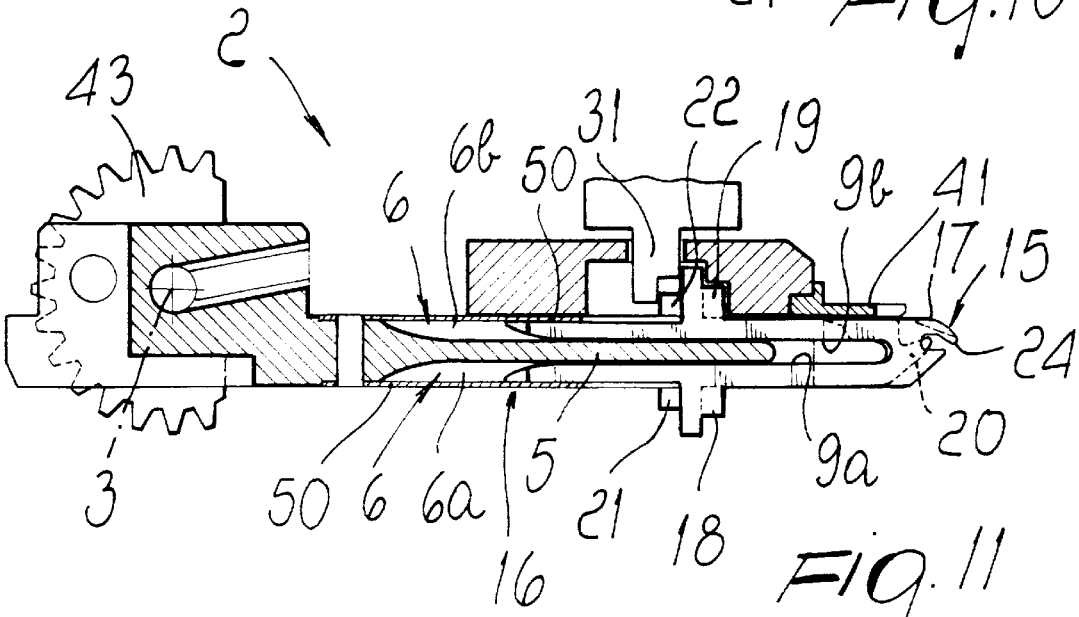

Then the heels 19 and 22 of the hooks 15 and 16 pass between the cam 31 and the profile 36*a* of the annular cam 36 in step-shaped regions which cause the movement of the hooks 15 and 16 toward the axis 8. In this case the hook 16 is moved toward the axis 8 more than the hook 15 (FIG. 11); the hooked end 20 of the second hook 16 is thus retracted with respect to the hooked end 17 of the first hook 15.

In this manner, the loop of knitting is transferred to the needle of the needle cylinder inserted previously between the hooks 15 and 16.

Figure 12:
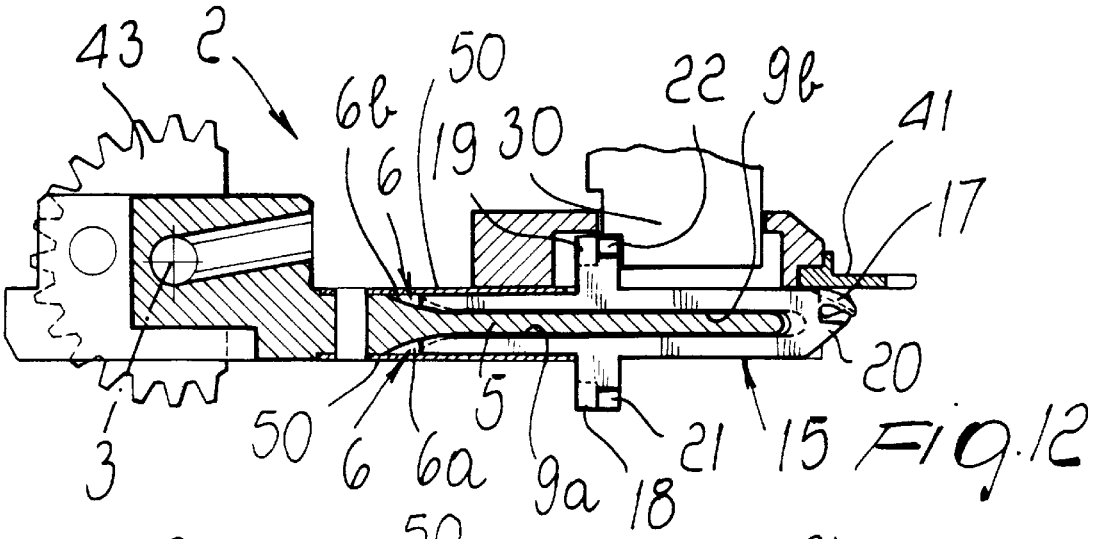

The heels 19 and 22 of the hooks 15 and 16 then engage the cam 30, in the working position, causing the retraction of the hooks 15 and 16 into the slots 6 or 6*a*, 6*b* and preparing the half-dial 2 for subsequent overturning about the axis 3 (FIG. 12).

The machine then continues to knit the item in a per se known manner.

Figure 13:
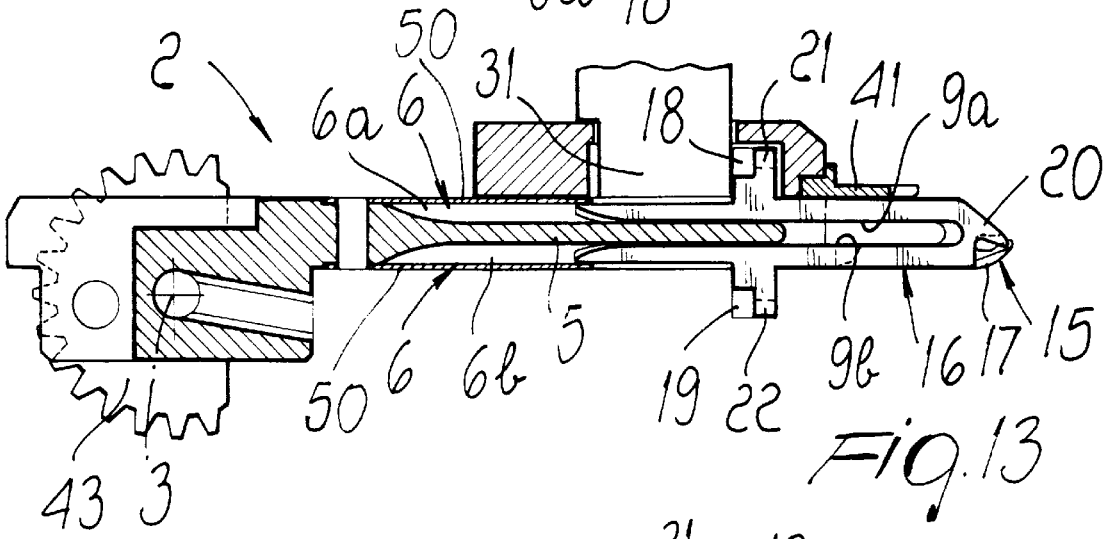
Figure 14:
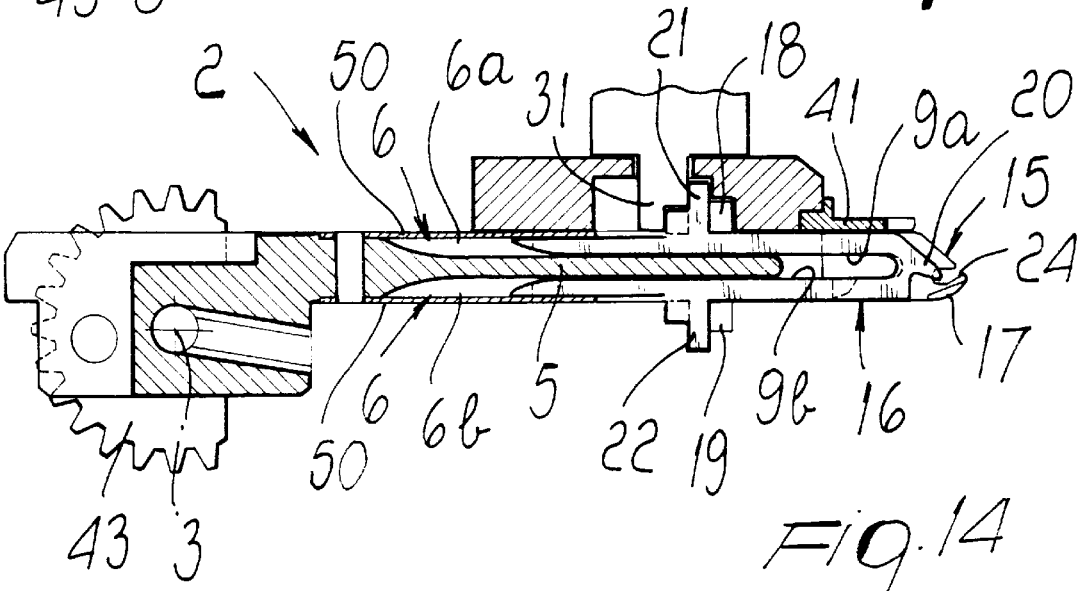

If the half-dial 2 is used together with the portion 4 as a conventional half-dial, in order to engage the loops formed by the needles of the needle cylinder the hooks 15 and 16 are moved toward the outside of the half-dial, i.e., away from the axis 8, by using the cam 31 and then toward the axis 8 by using the cam 36 (FIGS. 13 and 14). It should be noted that in the position shown in FIG. 14 the hooked end of the hook 16 is slightly retracted with respect to the hooked end 17 of the hook 15 and therefore does not hinder the engagement of the thread by the hook 15.

Figure 15:
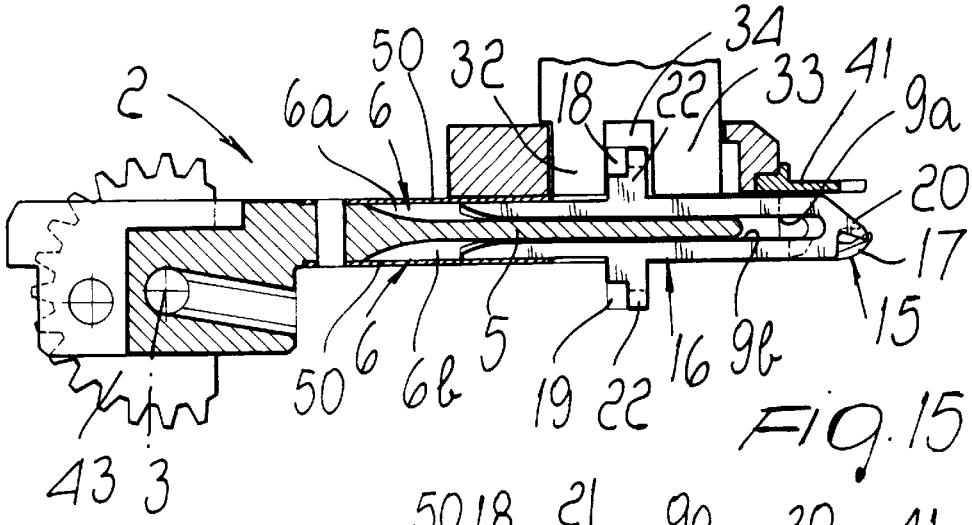
FIGS. 6 to 16 are schematic sectional views, taken along a radial plane, of an overturning portion of the dial in various operating conditions of the hooks.

The upper heels of the hooks 15 and 16 then pass through the passage 34 of the cams 32 and 33, in the working position; said cams cause the movement of the hooks 15 and 16 toward the axis 8 with an elastic flexing of the portion 23 of the second hook 16 toward the first hook 15. The hooked end of the second hook 16 engages the recess 24 of the hooked end 17 of the first hook 15 and the thread engaged by the hooks 15 is firmly locked on them by the hooks 16 which move, with their hooked end 20, toward the hooked end 17 of the hooks 15, closing it (FIG. 15).

Figure 16:
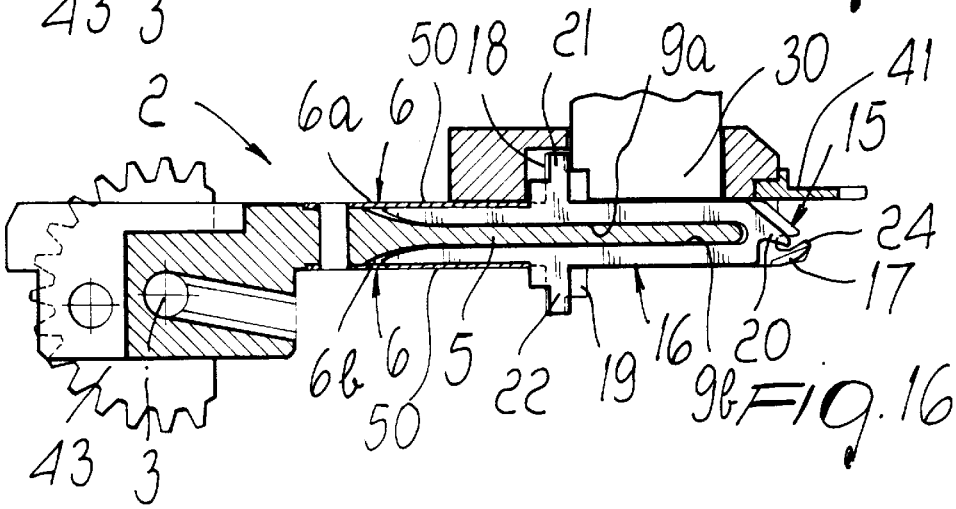
Figure 4:
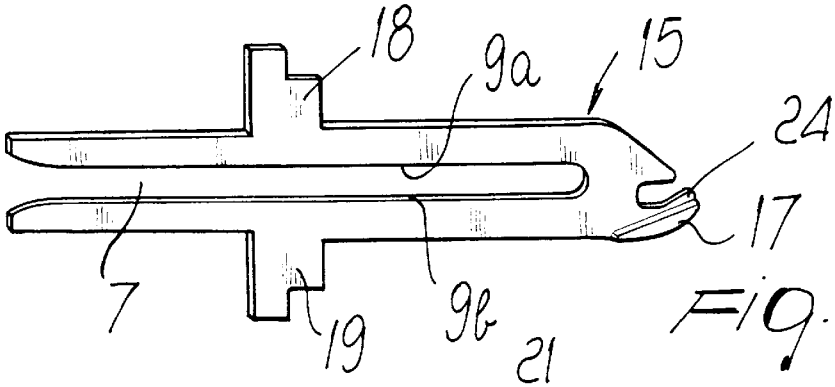
FIG. 4 is an enlarged-scale perspective view of a first hook of the dial according to the invention.
Figure 5:
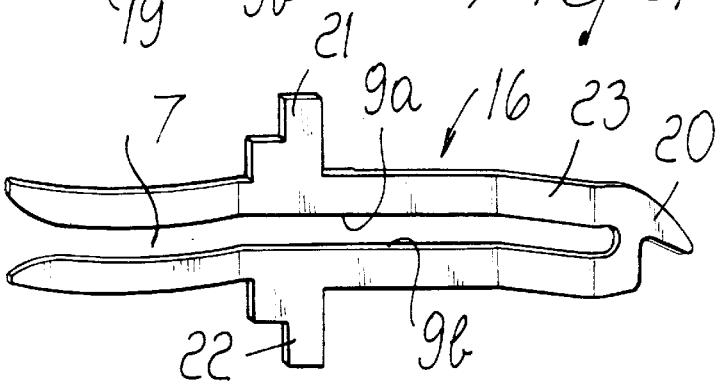
FIG. 5 is an enlarged-scale perspective view of a second hook of the dial according to the invention.

The subsequent release of the loops of the knitting is performed by way of the retraction of the hooks 15 and 16 into the corresponding slot 6 or slots 6*a*, 6*b*, which is performed by the cam 30, which is moved into the working position (FIG. 16).

It should be noted that in this position also, like the position shown in FIG. 14, the hooked end of the second hook 16 is retracted with respect to the hooked end 17 of the first hook 15 and therefore does not hinder at all the release of the loop of knitting, thus obtaining, for the hook 15, the same behavior as a conventional single hook.

If it is necessary to replace the hooks it is sufficient the lower the dial or half-dial according to the invention with respect to the cam support 40. In this position, the hooks can be easily extracted from the radial slots in which they are inserted.

It should be noted that during the overturning of the half-dial 2 about the diametrical axis 3 the hooks 15 and 16 are retained in the radial slots 6 by the friction between said hooks 15 and 16 and the slots. The friction can optionally be increased by providing lateral folds in the laminar body of the hooks, in a per se known manner.

In practice it has been observed that the dial or half-dial according to the invention fully achieves the intended aim, since it is considerably simpler, from a structural point of view, than conventional dials or half-dials and is therefore simpler to manufacture and assemble and furthermore makes hook maintenance particularly easy and simple.

Although the present invention has been conceived particularly for a dial with an overturning portion or for a half-dial meant to be installed in circular hosiery knitting machines for manufacturing tubular items closed at one longitudinal end, it can also be used advantageously for dials which do not have an overturning portion. In this case, the dial can be entirely executed like the half-dial 2 and the radial slots 6 or 6*a*, 6*b* optionally accommodate a single hook, provided only with the upper heel.

The dial or half-dial thus conceived is susceptible of numerous modifications and variations, all of which are within the scope of the inventive concept; all the details may furthermore be replaced with other technically equivalent elements.

In practice, the materials used, as well as the dimensions, may be any according to requirements and the state of the art.

The disclosures in Italian Patent Application No. MI98A002312 from which this application claims priority are incorporated herein by reference.

What is claimed is:

1. A dial or half-dial for single-cylinder circular hosiery knitting machines, for producing tubular items closed at one longitudinal end, comprising a dial or half-dial body which has two opposite faces and which is provided, on at least one of said two opposite faces, with a plurality of radial slots, each of which slideably accommodates at least one hook, each said at least one hook having a longitudinal slit which is open in a direction of a central axis of said dial or half-dial body, said slit giving a portion of a body of said at least one hook a bifurcated shape which engages said two opposite faces of said dial or half-dial body.

2. The dial or half-dial according to claim 1, wherein said body of the dial or half-dial has radial slots on both of said two opposite faces, said longitudinal slot having two mutually opposite parallel sides slideably engaging a bottom of the corresponding radial slots formed in the two faces of the dial or half-dial body.

3. The dial or half-dial according to claim 1, wherein each said at least one hook has a laminar body which is arranged on a radial plane of the dial or half-dial body and in which an opposite end with respect to the central axis of said dial or half-dial body is hook shaped and has at least one heel which protrudes, in an intermediate region of an extension of the body of the hook, so as to be parallel to the central axis of said dial or half-dial body, said at least one heel protruding from one of the two faces of said dial or half-dial body and being engageable by actuation means which face one face of said two faces of said dial or half-dial body for a movement of said at least one hook in a radial direction with respect to the body of the dial or half-dial.

4. The dial or half-dial according to claim 1, wherein each said at least one hook is provided with a first heel which protrudes from one face of said two faces of the dial or half-dial body and with a second heel which protrudes from an opposite face of said two faces of the dial or half-dial body, said first and second heels being engageable by actuation means which face one face of said two faces of said dial or half-dial body for a movement of said at least one hook in a radial direction with respect to the dial or half-dial body.

5. The dial or half-dial according to claim 4, wherein each one of said slots accommodates two hooks, respectively a first hook and a second hook, which lie mutually side by side and in which respective ends that are directed away from the central axis of said body of the dial or half-dial are hook shaped ends and mutually opposite, at least a portion of said second hook that is proximate to the hook shaped end of said second hook being flexible toward or away from said first hook, one side of said radial slots forming a lateral support for said flexible portion of said second hook for flexing said flexible portion toward the first hook following a movement of said second hook toward the central axis of said dial or half-dial body due to an action of said actuation means.

6. The dial or half-dial, according to claim 5, wherein the portion of said second hook which is flexible is thinner than a remaining part of said second hook.

7. The dial or half-dial according to claim 5, wherein a point of the hook shaped end of said first hook has, on a side thereof directed toward said second hook, a recess for accommodating a point of the hook shaped end of said second hook following an elastic flexing of said flexible portion of said second hook toward said first hook.

8. The dial or half-dial according to claim 5, wherein in an unloaded state said flexible portion of said second hook has an arc-like shape having a concavity directed toward one side of said first hook.

9. The dial or half-dial according to claim 1, wherein a portion of the body of the dial or half-dial is overturnable about a diametrical axis of the dial or half-dial.

10. The dial or half-dial according to claim 3, wherein said actuation means comprise actuation cams which face one face of said two opposite faces of said dial or half-dial body and form paths which are engageable by the at least one heel of said at least one hook, said paths being shaped so as to produce a movement of said hooks in a radial direction of the dial or half-dial body.

11. The dial or half-dial according to claim 10, wherein an upper heel and a lower heel of said at least one hook is selectively engageable with said cams following an overturning of said portion of the dial or half-dial body about said diametrical axis.

12. The dial or half-dial according to claim 5, wherein the heels of the pair of said first and second hooks arranged in a same radial slot of the dial or half-dial body are arranged side by side and partially overlap laterally, the heels of said first hook and of said second hook having regions which extend differently in a radial direction of the dial or half-dial body with respect to corresponding regions of the heels of the second hook for a different movement, along the corresponding radial slot, of said first hook with respect to said second hook.

13. The dial or half-dial according to claim 12, wherein the heels of said first hook have a step-shaped region on a side thereof that is directed toward the hook shaped end of the first hook and the heels of said second hook have a step-shaped region on a side thereof that is directed toward an end that lies opposite with respect to the hook shaped end of the second hook.

14. The dial or half-dial according to claim 13, wherein in at least some of said actuation cams there is defined a profile that is engageable by one of two sides of the heels of the hooks and matches a shape of the side of the heel of the hooks.

15. The dial or half-dial according to claim 5, further comprising means adapted to contrast or limit an elastic flexing of said hooks in a corresponding plane of arrangement that lies radially with respect to the body of the dial or half-dial.

16. The dial or half-dial according to claim 15, wherein said means adapted to contrast or limit an elastic flexing of said hooks comprise at least one cover which is applied to at least one of the two opposite faces of the body of the dial or half-dial, said at least one cover closing at least the side of said radial slots that lies opposite a bottom in a region occupied by a portion of said hooks that protrudes from said heels toward the central axis of said dial.

17. A hook for single-cylinder circular hosiery knitting machines, comprising a laminar body which has a first hooked end and a second end arranged opposite said first hooked end, said laminar body having a longitudinal extension which extends between said first hooked end and said second end, said laminar body being provided with a longitudinal slit which extends alone said longitudinal extension from said first hooked end to said second end and which is open at said second end such that said second end is a second open end, said slit giving a portion of the laminar body of the hook a bifurcated shape for engaging two opposite faces of a body of a dial or half-dial on which the hook is to be installed.

18. The hook according to claim 17, wherein said longitudinal slit has two mutually parallel opposite sides.

19. The hook according to claim 18, wherein at least a portion of said laminar body of said hook that lies adjacent to the first hooked end is laterally flexible.

20. The hook according to claim 19, wherein said flexible portion is thinner than a remaining part of the laminar body of said hook.

21. The hook according to claim 20, wherein in an unloaded state said flexible portion is arc-shaped and concave on one side of the hook.

22. The hook according to claim 17, wherein a point of said first hooked end has, on one side of the hook, a recess for accommodating a point of a hooked end of a contiguous hook.

23. The hook according to claim 17, wherein the laminar body of the hook is provided with a first heel, which protrudes transversely for protruding from an upper face of a body of a dial or half-dial for receiving the hook, and with a second heel, which protrudes transversely from a side of the laminar body of the hook that lies opposite with respect to a side that supports said first heel for protruding from an opposite face of the dial or half-dial body.

* * * * *